US007995962B2

(12) United States Patent
Matsuo

(10) Patent No.: US 7,995,962 B2
(45) Date of Patent: Aug. 9, 2011

(54) SHEET POST-PROCESSING APPARATUS AND IMAGE FORMING APPARATUS PROVIDED WITH THE SAME

(75) Inventor: Takeshi Matsuo, Osaka (JP)

(73) Assignee: Kyocera Mita Corporation (JP)

( * ) Notice: Subject to any disclaimer, the term of this patent is extended or adjusted under 35 U.S.C. 154(b) by 654 days.

(21) Appl. No.: 12/120,961

(22) Filed: May 15, 2008

(65) Prior Publication Data

US 2008/0286022 A1 Nov. 20, 2008

(30) Foreign Application Priority Data

May 15, 2007 (JP) ..... 2007-128773

(51) Int. Cl.
*G03G 15/00* (2006.01)
*B65H 37/04* (2006.01)

(52) U.S. Cl. ..... 399/410; 399/408; 270/58.08

(58) Field of Classification Search ..... 399/407, 399/408, 410; *G03G 15/00; B65H 37/04*
See application file for complete search history.

(56) References Cited

U.S. PATENT DOCUMENTS

| | | | | |
|---|---|---|---|---|
| 5,447,298 | A * | 9/1995 | Watanabe et al. | 270/58.11 |
| 6,164,511 | A * | 12/2000 | Chung et al. | 227/148 |
| 6,427,997 | B1 * | 8/2002 | Hirota et al. | 270/58.12 |
| 6,575,446 | B2 * | 6/2003 | Wakabayashi et al. | 270/58.07 |
| 2006/0016851 | A1 * | 1/2006 | Yoshie | 227/155 |
| 2006/0216098 | A1 * | 9/2006 | Lyman | 400/613 |
| 2007/0132176 | A1 * | 6/2007 | Kawata | 271/220 |
| 2007/0138730 | A1 * | 6/2007 | Tsutsui et al. | 270/58.09 |

FOREIGN PATENT DOCUMENTS

| | | | |
|---|---|---|---|
| JP | 8-310716 | | 11/1996 |
| JP | 09235070 | A * | 9/1997 |
| JP | 09295749 | A * | 11/1997 |
| JP | 10120284 | A * | 5/1998 |
| JP | 10-181987 | | 7/1998 |
| JP | 11180628 | A * | 7/1999 |
| JP | 2000-185868 | | 7/2000 |
| JP | 2000335815 | A * | 12/2000 |
| JP | 2001-139214 | | 5/2001 |
| JP | 2002226129 | A * | 8/2002 |
| JP | 2006103856 | A * | 4/2006 |

OTHER PUBLICATIONS

Machine translation of JP 11180628 A, JPO, Jan. 21, 2011.*

* cited by examiner

*Primary Examiner* — Judy Nguyen
*Assistant Examiner* — 'Wyn' Q Ha
(74) *Attorney, Agent, or Firm* — Gerald E. Hespos; Michael J. Porco

(57) ABSTRACT

A sheet post-processing apparatus (1) includes a first stapler (4) and a second stapler (5) for stapling the stack of sheets on a stack tray (61), a first moving frame member (10) on which the first stapler (4) is mounted rotatably, a second moving frame member (11) on which the second stapler (5) is mounted, a rotating member (20) rotatably mounted on the first moving frame member (10), the rotating member (20) so held in engagement with the first moving frame member (10) as to move linearly the first moving frame member (10) by rotation of the rotating member (20), and also rotating the first stapler (4) by rotation of the rotating member (20), and a single drive power source (16) for driving the rotating member (20).

14 Claims, 12 Drawing Sheets

SHEET POST-PROCESSING APPARATUS AND IMAGE FORMING APPARATUS PROVIDED WITH THE SAME

BACKGROUND OF THE INVENTION

1. Field of the Invention

The present invention relates to a sheet post-processing apparatus having a function of stacking a plurality of sheets discharged from an image forming apparatus and of stapling the same.

2. Description of the Related Art

A sheet post-processing apparatus generally includes a stacking unit for stacking a plurality of sheets discharged from an image forming apparatus such as a copying machine while conveying the sheets along a pair of guide members and a stapling unit for stapling the stacked sheets.

There are sheet post-processing apparatuses including a stapling unit provided with a plurality of staplers which are linearly and rotatably movable so that stapling such as front-stapling, rear-stapling, two-point stapling and corner stapling is performed with respect to the stack of sheets (for example, Japanese Patent Unexamined Publication Nos. 2000-185868, 2001-139214, 10-181987 and 8-310716, hereinafter referred to as patent documents 1-4).

However, since the sheet post-processing apparatuses disclosed in the patent documents 1-4 require individual drive power sources for linear movement and rotational movement of the stapler, the number of components increases to thereby cause a cost to rise and a drive control of each drive power source to be complex.

SUMMARY OF THE INVENTION

Therefore, in view of the circumstance described above, an object of the present invention is to provide a sheet post-processing apparatus capable of reducing the number of components, reducing the cost in accordance with the reduction in the number of components, and simplifying the control of the drive power source.

For the purpose of achieving the object, a sheet post-processing apparatus in accordance with an aspect of the present invention includes a stack tray on which a plurality of sheets is stacked, a first stapler and a second stapler for stapling the stack of sheets on the stack tray, a first moving frame member on which the first stapler is mounted rotatably, a second moving frame member on which the second stapler is mounted, an interlocking mechanism for interlocking the first moving frame member and the second moving frame member to allow the first moving frame member and the second moving frame member to move linearly in opposite directions from each other, a fixed frame member for supporting the first moving frame member and the second moving frame member in such a manner that the first moving frame member and the second moving frame member can undergo the linear movement, a rotating member rotatably mounted on the first moving frame member, the rotating member so held in engagement with the first moving frame member as to move linearly the first moving frame member by rotation of the rotating member and also rotating the first stapler by rotation of the rotating member, and a single drive power source for driving the rotating member.

These and other objects, features and advantages of the present invention will become more apparent upon reading of the following detailed description along with the accompanied drawings.

DETAILED DESCRIPTION OF THE PREFERRED EMBODIMENTS

Hereinafter, an embodiment of the present invention will be described with reference to the drawings.

Figure 1:
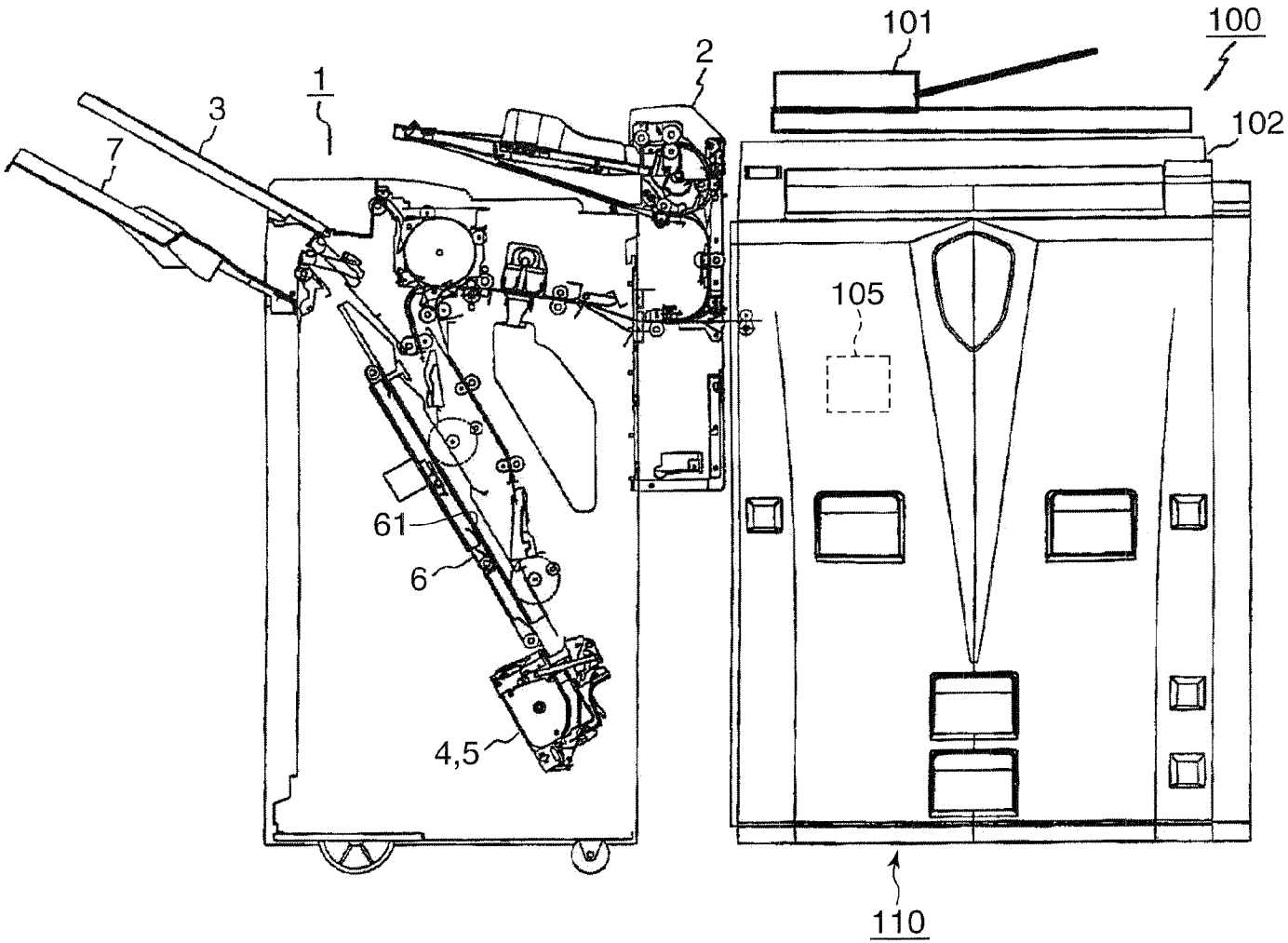
FIG. 1 is a front sectional view showing a sheet post-processing apparatus in accordance with the present invention and a front view showing an apparatus main body of an image forming apparatus.

FIG. 1 is a front sectional view showing a sheet post-processing apparatus in accordance with the present invention and also shows a front view of an apparatus main body of an image forming apparatus.

An image forming apparatus 100 includes an apparatus main body 110 such as a copying machine. An automatic document feeder (ADF) 101 and an image reading unit 102 are provided on top of the apparatus main body 110. The apparatus main body 110 accommodates a sheet-feeding section for feeding sheets, an image forming section including a photosensitive drum and a developing device for forming a toner image on the photosensitive drum, a transferring section for transferring the toner image onto the sheet, a fixing section for fixing the toner image on the sheet, and a sheet-discharging section for discharging the sheet bearing the fixed toner image to outside of the apparatus main body 110.

The image forming apparatus 100 further includes a sheet post-processing apparatus 1 arranged on the side of the apparatus main body 110. The sheet post-processing apparatus 1 performs stacking and stapling with respect to sheets sequentially conveyed from the apparatus main body 110. An inserter 2 connected to the apparatus main body 110 is arranged on top of the sheet post-processing apparatus 1. On the other hand, the sheet post-processing apparatus 1 accommodates a stapling unit including a stack tray 61 on which the sheets conveyed from the apparatus main body 110 are stacked and a stapling unit having a pair of staplers 4 and 5 for stapling the stacked sheets on the stack tray 61. The sheet post-processing apparatus 1 also includes a first conveying passage for directly guiding the sheets discharged from the apparatus main body 110 to a sheet-discharging tray 3 and a second conveying passage for guiding the sheets to the stapling unit. In the present embodiment, two staplers 4 and 5 are arranged in a direction perpendicular to the sheet of FIG. 1.

The stack of sheets which is stapled by the staplers 4 and 5 is conveyed by a conveying belt 6 to a sheet-discharging tray 7 and then discharged.

Next, details of the configuration of the stapling unit of the sheet post-processing apparatus 1 in accordance with the present invention will be described with reference to FIGS. 2 through 7.

Figure 2:
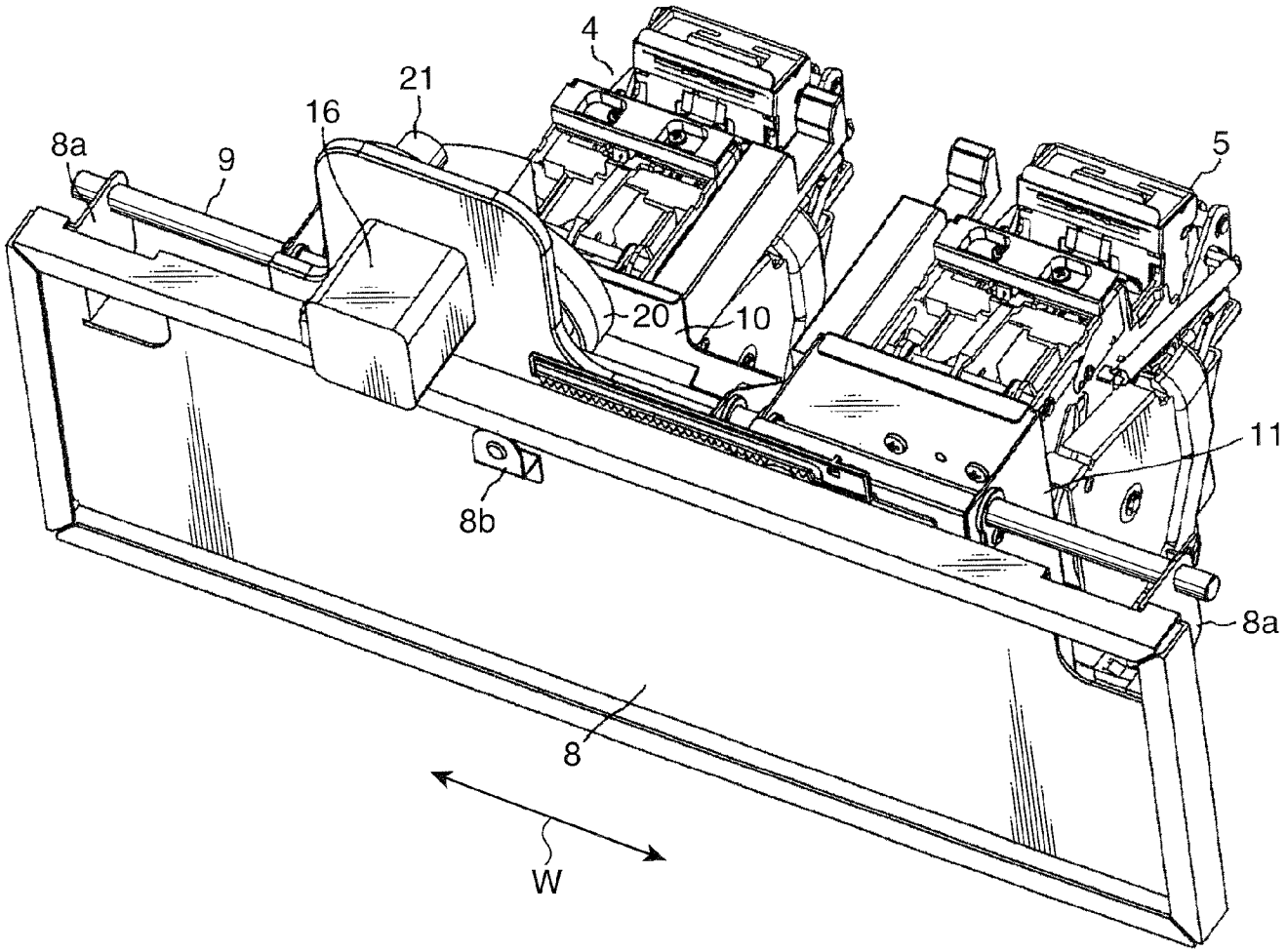
FIG. 2 is a perspective view showing a stapling unit of the sheet post-processing apparatus.
Figure 3:
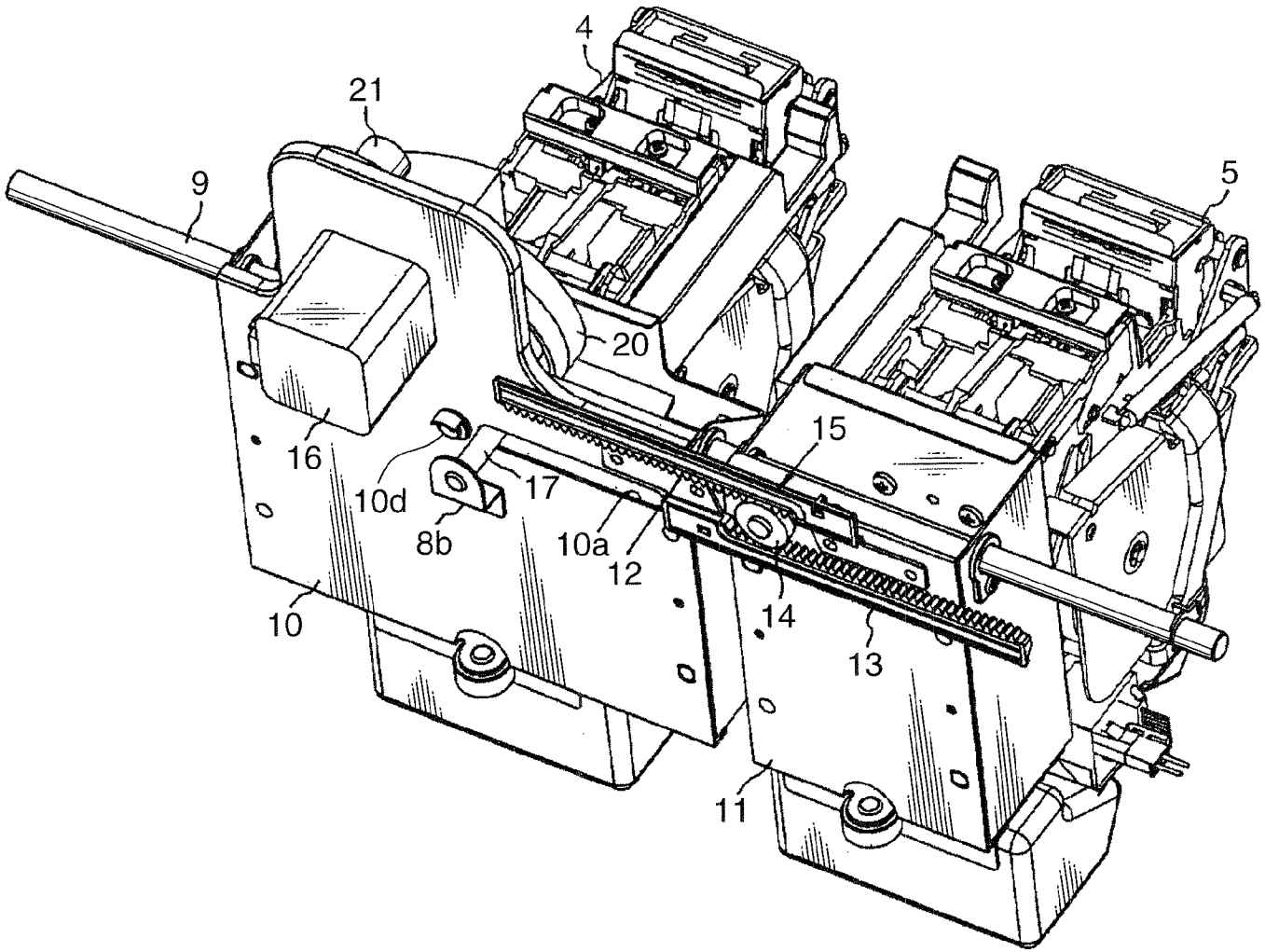
FIG. 3 is a perspective view showing a state where a fixed frame member of the stapling unit is removed.
Figure 4:
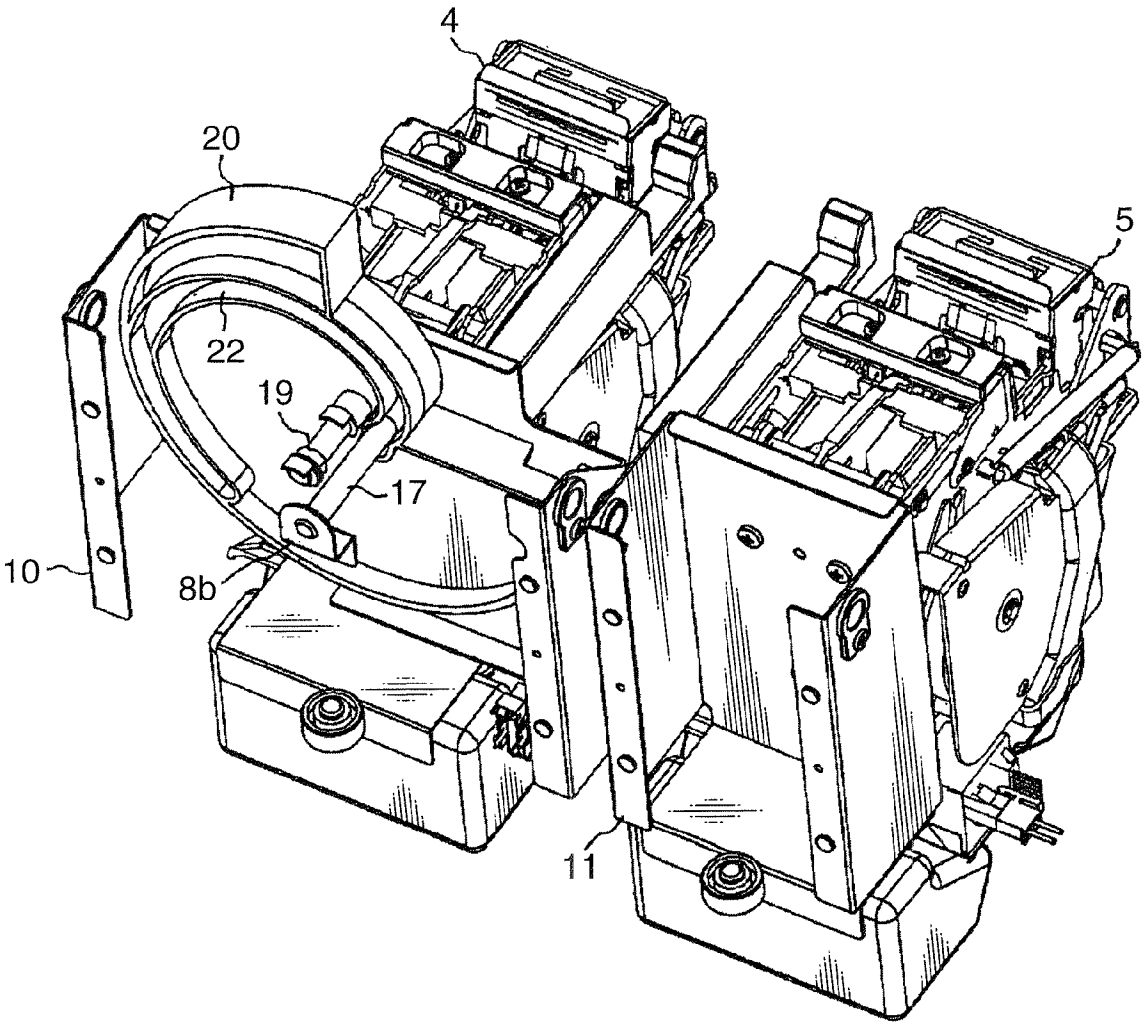
FIG. 4 is a perspective view showing a state where the fixed frame member and a moving frame member of the stapling unit are removed.
Figure 5:
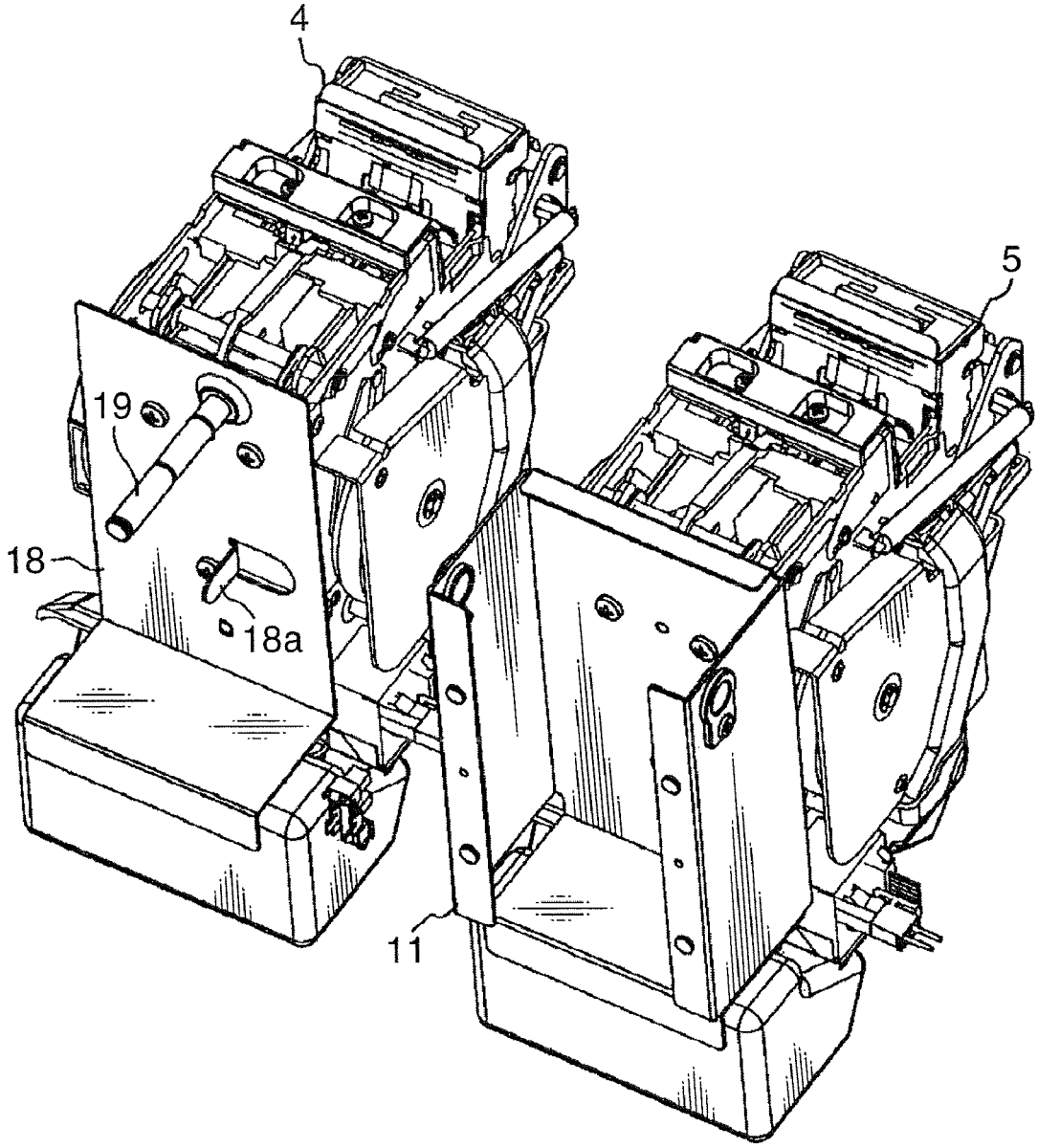
FIG. 5 is a perspective view showing staplers and a rotating frame member of the stapling unit.
Figure 6:
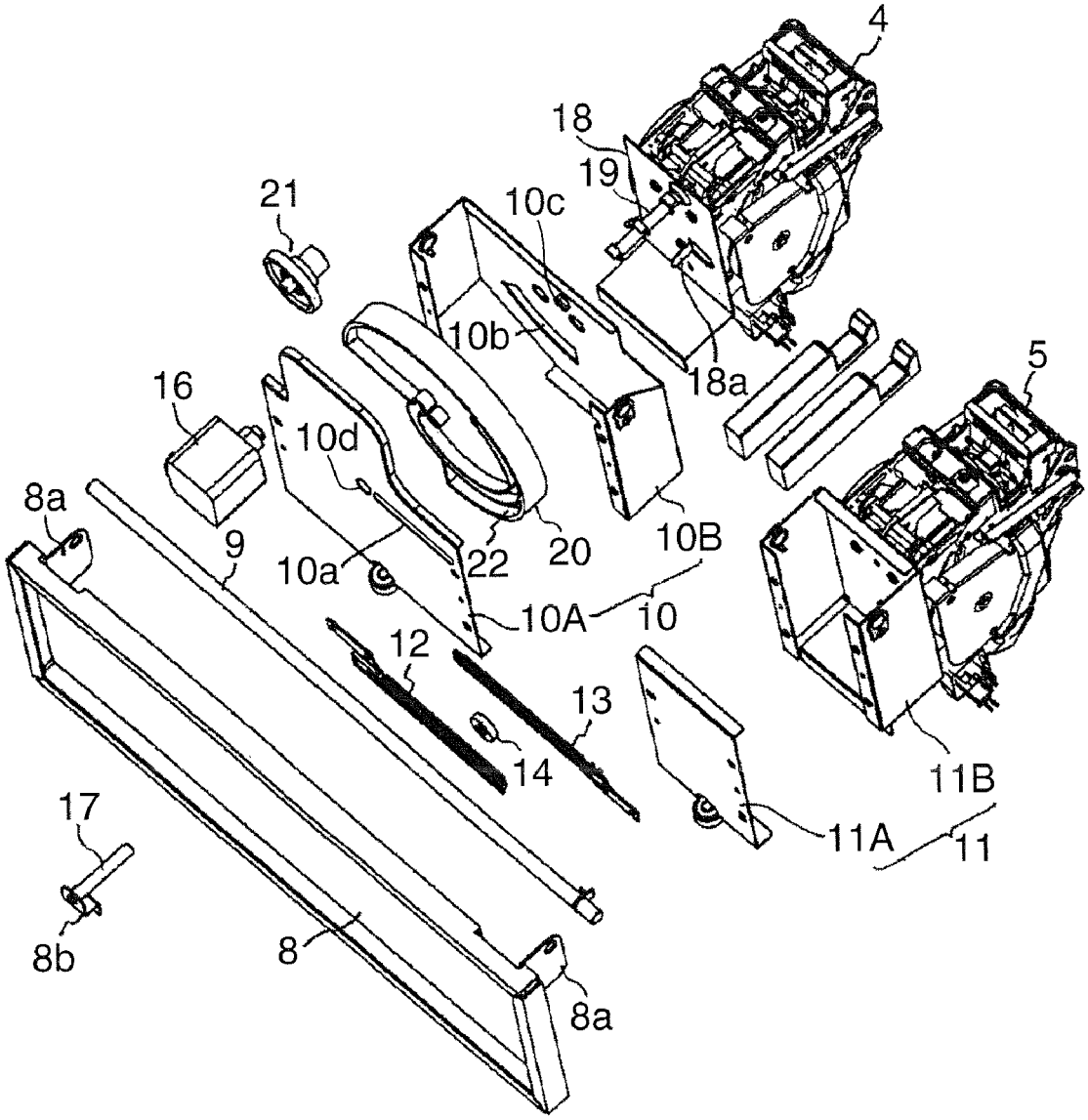
FIG. 6 is an exploded perspective view showing the stapling unit.
Figure 7:
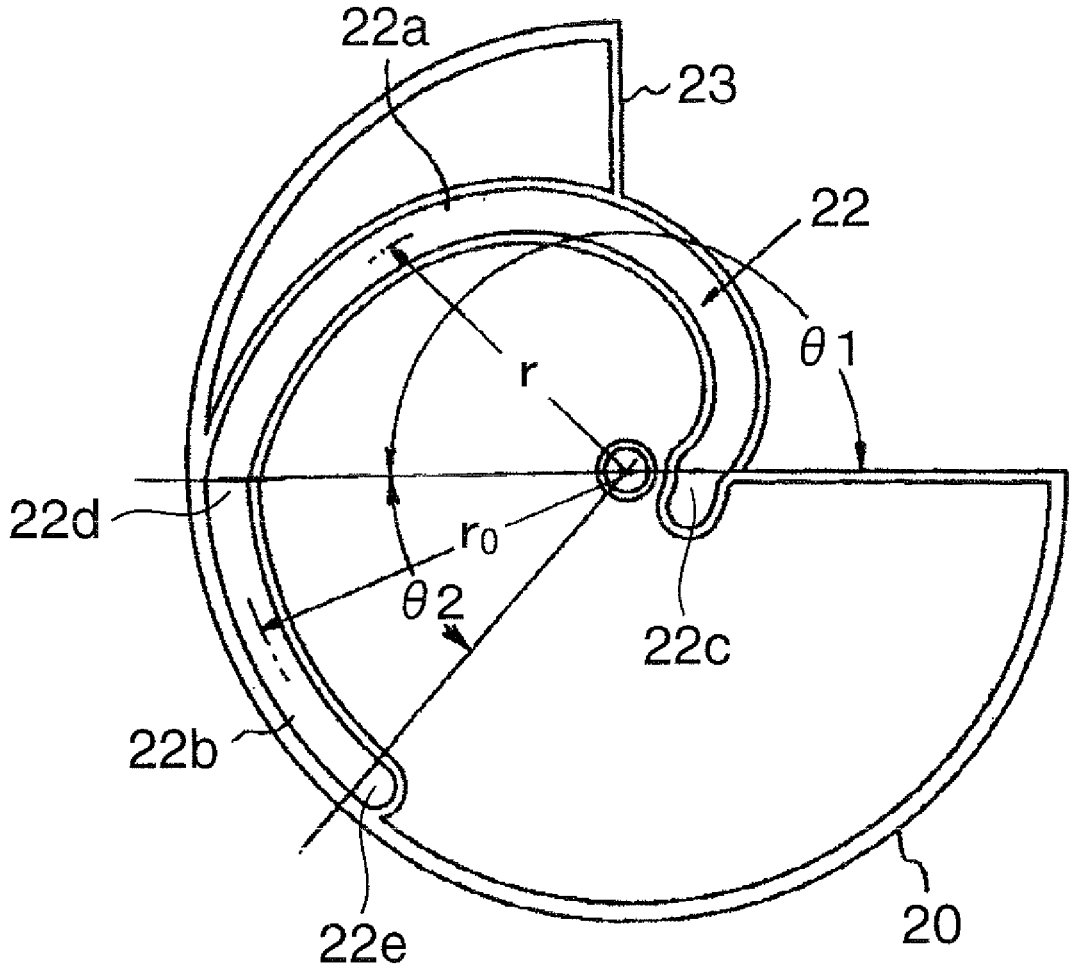
FIG. 7 is a front view showing a gear of the stapling unit.

FIG. 2 is a perspective view showing the stapling unit. FIG. 3 is a perspective view showing a state where a fixed frame member of the stapling unit is removed from the stapling unit. FIG. 4 is a perspective view showing a state where the fixed frame member and a moving frame member of the stapling unit are removed from the stapling unit. FIG. 5 is a perspective view showing staplers of the stapling unit. FIG. 6 is an exploded perspective view of the stapling unit. FIG. 7 is a front view showing a gear of the stapling unit.

As shown in FIG. 2, the stapling unit includes a fixed frame member 8 extending in a width direction W of the stapling unit and provided with brackets 8*a* on its opposite end portions in the width direction, a round rod-like guiding bar 9 inserted to the brackets 8*a*, 8*a* and supported along the fixed frame member 8, and first and second moving frame members 10 and 11 linearly movable on the guiding bar 9 along the fixed frame member 8 in opposite directions from each other. As shown in FIG. 3, the stapling unit further includes a lack rack-and-pinion mechanism (interlocking mechanism) 15 constituted by a pair of racks 12 and 13 provided respectively on the first moving frame member 10 and the second moving frame member 11 along the guiding bar 9 and a pinion 14 provided between the rack 12 and 13 and in mesh with the racks 12 and 13. The rack-and-pinion structure 15 enables the second moving frame member 11 to move linearly along the guiding bar 9 in a direction opposite to a moving direction of the first moving member 10 by the same distance in conjunction with an operation of the first moving member 10 when the first moving frame member 10 moves linearly along the guiding bar 9.

As shown in FIGS. 2 and 3, a motor 16 as a single drive power source for the stapling unit is fixed to the first moving frame member 10. Driving of the motor 16 is controlled by a controller 105 (FIG. 1) provided in the apparatus main body 110. The first moving frame member 10 is provided with a through hole 10*a* which is elongate in the width direction W. The fixed frame member 8 is provided with a bracket 8*b*. The bracket 8*b* is provided with an engagement shaft 17 which extends horizontally in a direction substantially perpendicular to the width direction W so as to pass through the through hole 10*a* of the first moving frame member 10 to project into the first moving frame member 10.

As shown in FIG. 6, the first moving frame member 10 has members 10A and 10B. These members 10A and 10B are assembled to form a rectangular frame member. The second moving frame member 11 has members 11A and 11B. These members 11A and 11B are assembled to form a rectangular frame member. The stapling unit further includes a rotating frame member 18 which is rotatably supported by the first moving frame member 10. In particular, as shown in FIGS. 5 and 6, the rotating frame member 18 is provided with a rotational shaft 19 which projects horizontally in a direction substantially perpendicular to the width direction W. The rotational shaft 19 is inserted in a through hole 10*c* formed in the member 10B and a through hole 19*d* formed in the member 10A to extend in the first moving frame member 10 so that it is supported by the first moving frame member 10. As described above, the rotating frame member 18 is so supported by the first moving frame member 10 as to be rotatable about the rotational shaft 19. Further, the rotating frame member 18 is provided with a stopper projection 18*a* (second abutment portion) projecting in the same direction as the projecting direction of the rotational shaft 19.

The stapling unit further includes a stapler 4 mounted on a surface of the rotating frame member 18 opposite to the surface from which the rotational shaft 19 of the rotating frame member 18 projects and a stapler 5 mounted on the member 11B of the second moving frame member 11.

Figure 9:
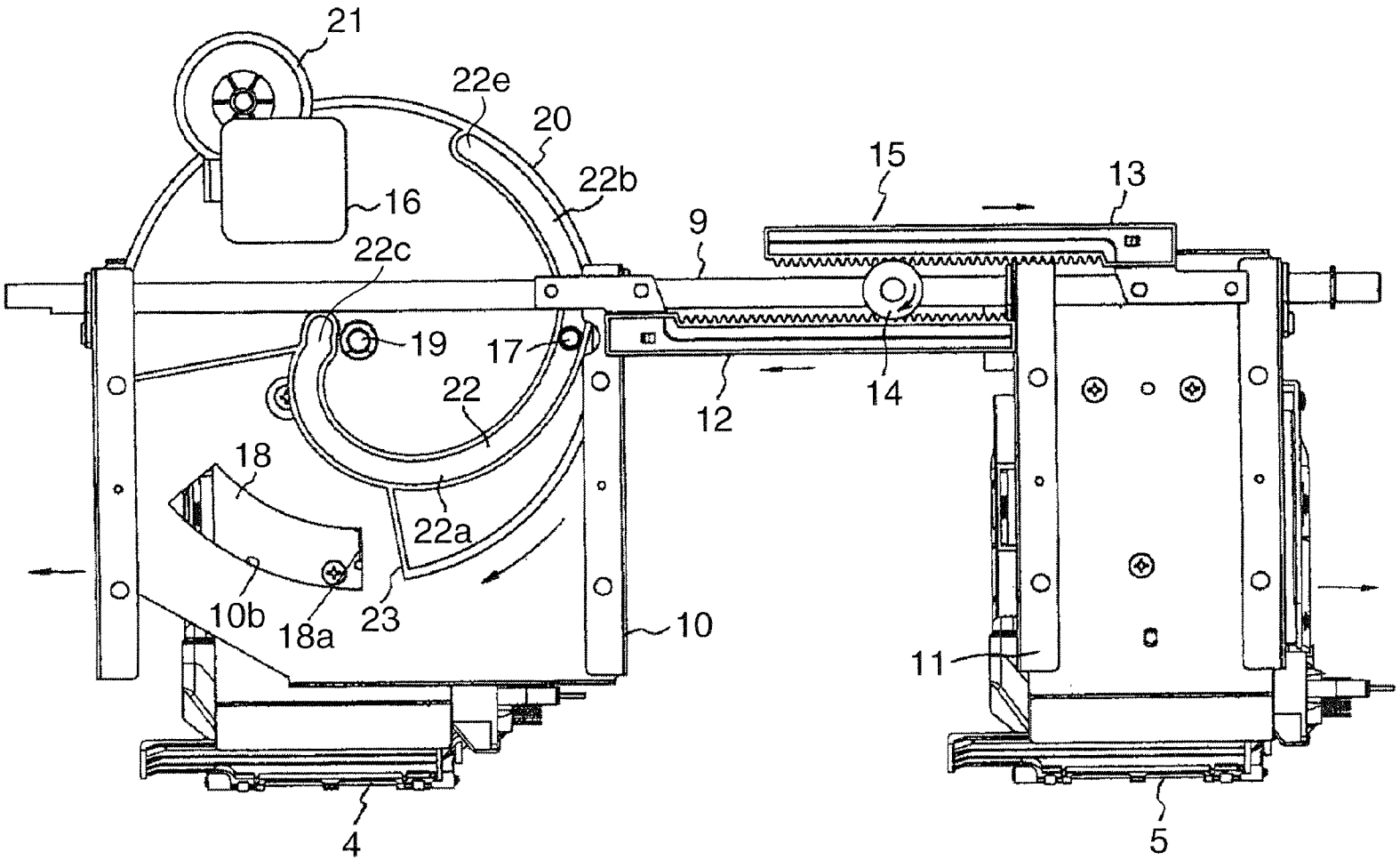
FIG. 9 shows an operation of the stapling unit.

Further, the stapling unit includes a gear (rotating member) 20 provided in the first moving frame member 10 i.e. provided between the members 10A and 10B. The gear 20 is supported rotatably by the rotational shaft 19 extending in the first moving frame member 10. The gear 20 is in mesh with a small-diameter idle gear (a gear which transmits rotation of an output shaft of the motor 16 to the gear 20) 21 which is mounted to the output shaft of the motor 16. As shown in FIG. 6, an arcuate guide hole 10*b* is formed in the member 10B of the first moving frame member 10. The stopper projection 18*a* of the rotating frame member 18 is engaged in the guide hole 10*b* while projecting into the first moving frame member 10 (FIG. 9).

As shown in FIG. 7, the gear 20 has an end face formed with an engagement groove 22 and an abutment portion (first abutment portion) 23. The engagement groove 22 includes a first arcuate groove 22*a* and a second arcuate groove 22*b* continuing from the first arcuate groove 22*a*. As shown in FIG. 4, a leading end portion of the engagement shaft 17 extending horizontally from the fixed frame member 8 engages with the engagement groove 22. The abutment portion 23 has an abutment surface which is so formed as to project radially outward from the first arcuate groove 22*a* of the engagement groove 22.

The first arcuate groove 22*a* of the engagement groove 22 is so formed as to begin at the vicinity of a rotation center of the gear 20 (in other words, the rotational shaft 19) and extend over a first angle range θ1 (180 degrees in the present embodiment) with respect to the rotation center of the gear 20. Further, a distance "r" between the first arcuate groove 22*a* and the rotation center (rotational shaft 19) of the gear 20 is so set as to become gradually larger over the first angle range θ1 as a rotation angle θ of the gear 20 becomes larger. The first arcuate groove 22*a* thus extends in a spiral curve (or clothoid curve). The second arcuate groove 22*b* is so formed as to continue from the first arcuate groove 22*a* and extend over a second angle range θ2 (45 degrees in the present embodiment) with respect to the rotation center of the gear 20. Further, a distance $r_0$ between the second arcuate groove 22*b* and the rotation center of the gear 20 is so set as to be constant over the second angle range θ2. The second arcuate groove 22*b* thus extends in an arcuate curve. The maximum value of the distance "r" within the first angle range θ1 is equal to the distance $r_0$.

Next, an operation of the stapling unit so configured as described above will be described with reference to FIGS. 8 through 11.

Figure 10:
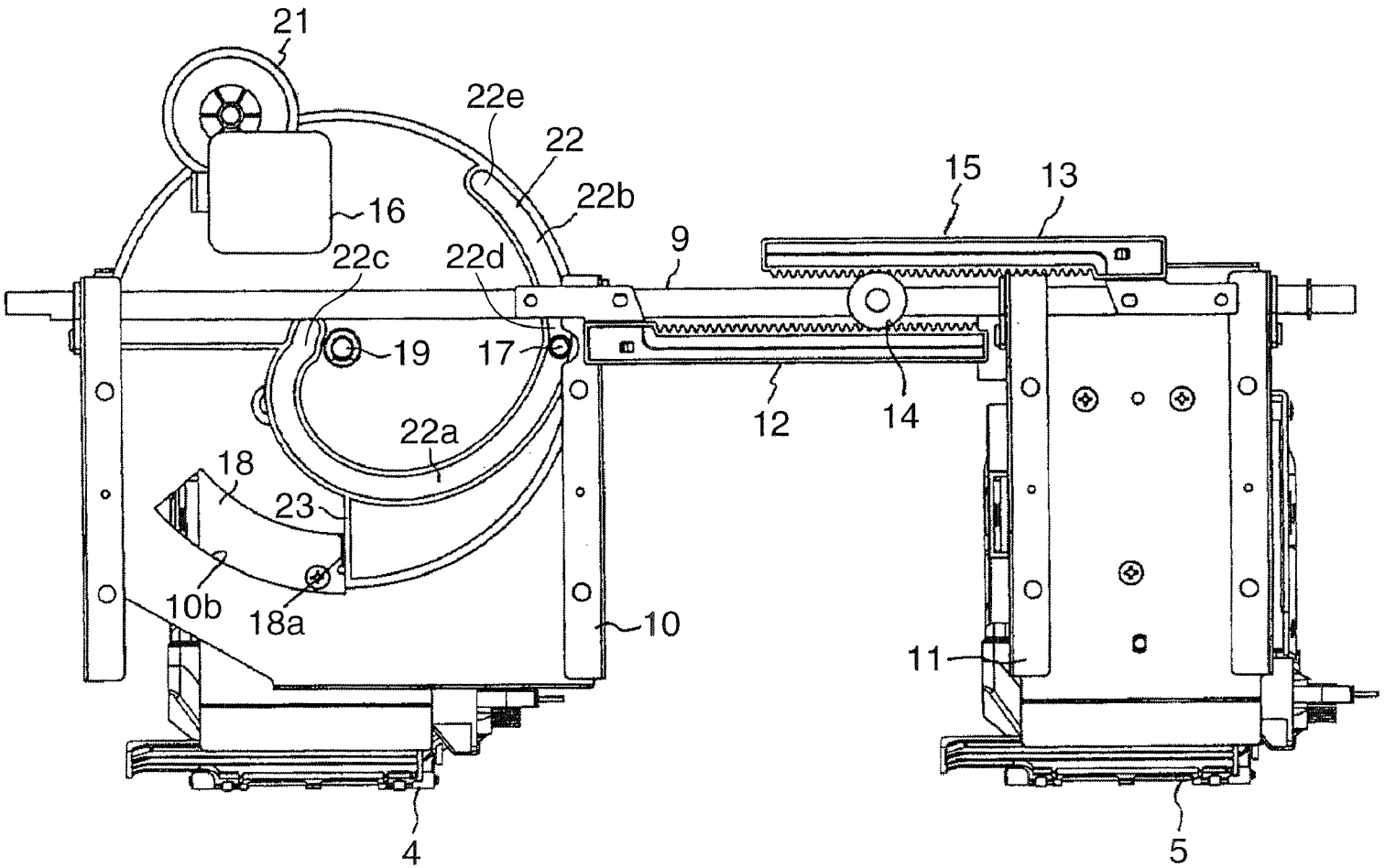
FIG. 10 shows an operation of the stapling unit.
Figure 11:
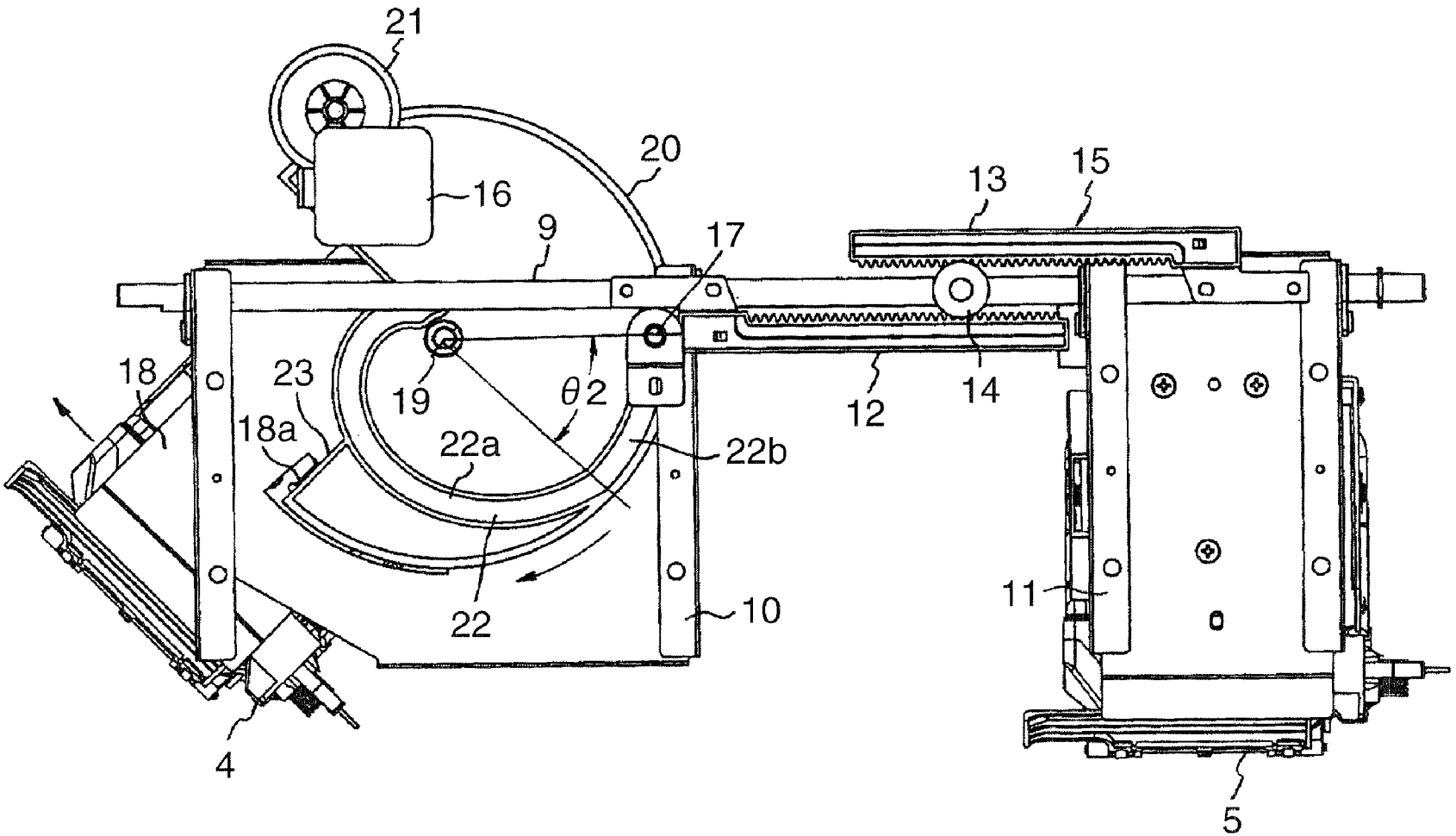
FIG. 11 shows an operation of the stapling unit.
Figure 12:
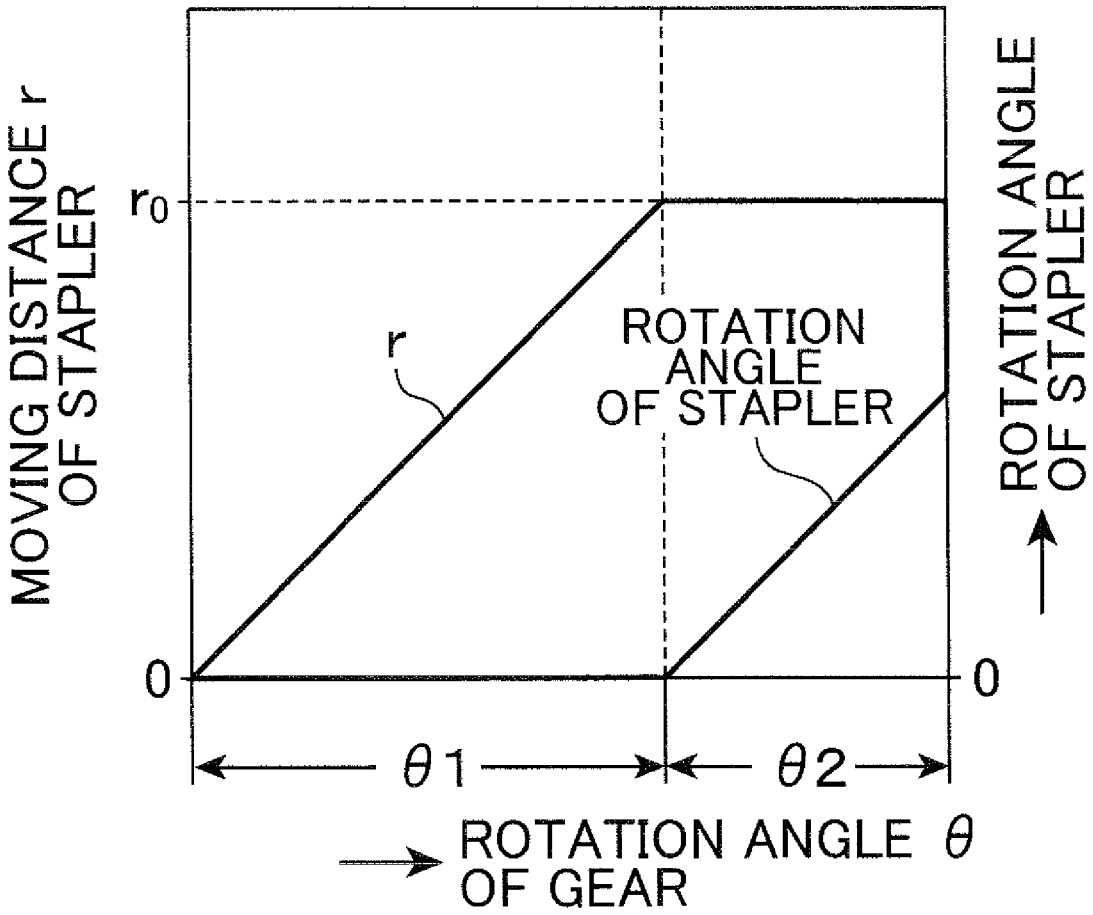
FIG. 12 shows changes in linear moving distance and rotation angle of the stapler with respect to rotation angle of the gear.

FIGS. 8 through 11 show operations of the stapling unit, and FIG. 12 shows changes in linear moving distance and rotation angle of the stapler with respect to the rotation angle of the gear 20.

Figure 8:
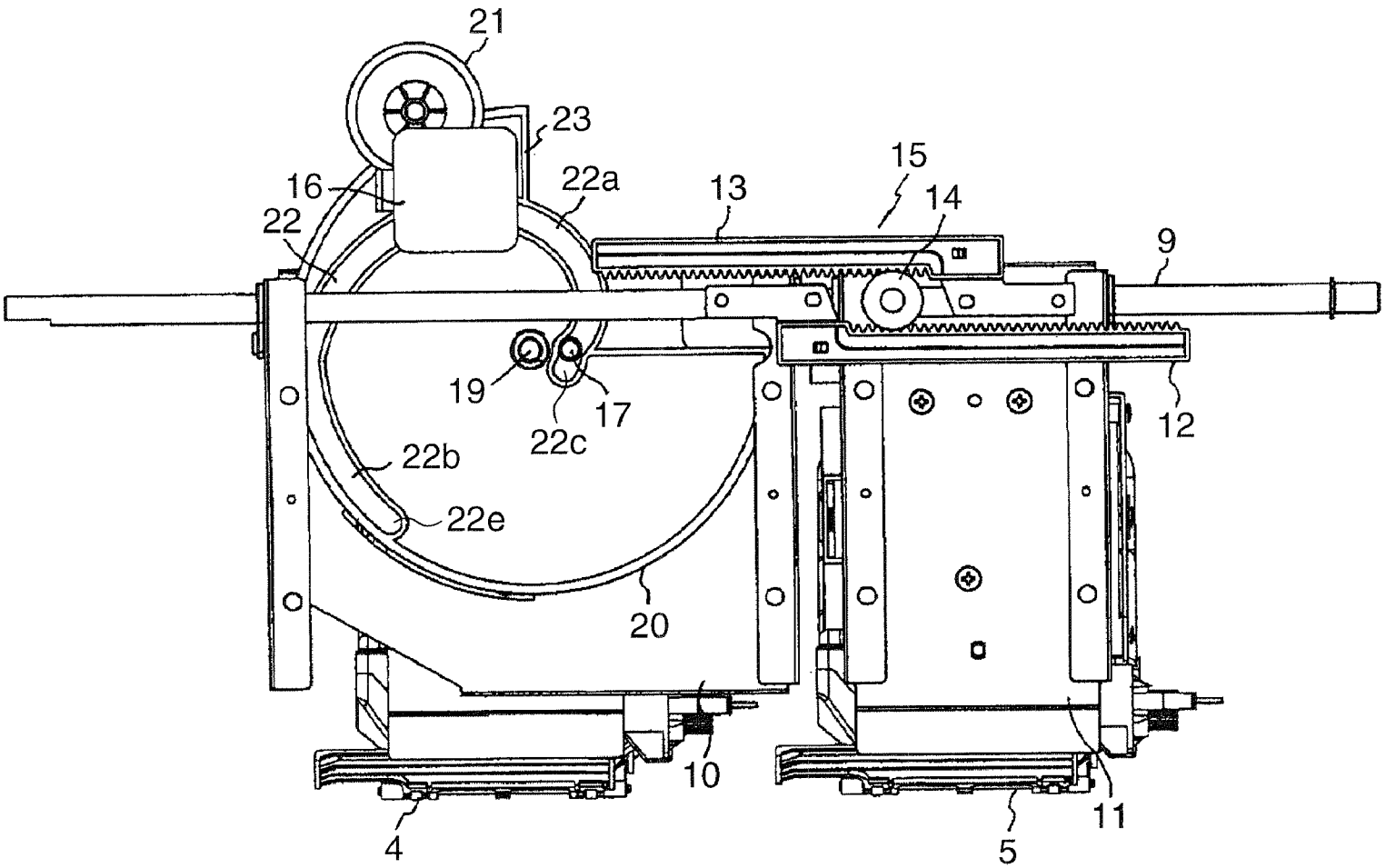
FIG. 8 shows an operation of the stapling unit.

In an initial state shown in FIG. 8, the engagement shaft 17 extending from the fixed frame member 8 engages with a groove end (starting point) 22*c* of the first arcuate groove 22*a* of the engagement groove 22 of the gear 20, and the first and second moving frame members 10 and 11 and the staplers 4 and 5 supported by these members 10 and 11 are at positions closest to each other. Respective linear moving distances of the staplers 4 and 5 at this time are zero as shown in FIG. 12.

When the controller 105 activates the motor 16 for performing the stapling, rotation of the output shaft of the motor 16 is transmitted to the gear 20 through the drive gear 21 so that the gear 20 is rotated in the direction (clockwise direction) shown by arrow shown in FIG. 9. This changes an engagement position of the first arcuate groove 22*a* of the engagement groove 22 with respect to the engagement shaft 17. As described above, the first arcuate groove 22*a* is so formed as to extend over the first angle range θ1 (180 degrees in the present embodiment) with respect to the rotation center (or the rotational shaft 19) of the gear 20. Further, the distance "r" between the first arcuate groove 22*a* and the rotation center (rotational shaft 19) of the gear 20 is so set as to become larger gradually within the first angle range θ1 as the rotation angle θ of the gear 20 becomes larger. Accordingly, when the gear 20 rotates within the first angle range θ1 (in other words, when the rotation angle θ of the gear 20 is within the first angle range θ1), the first moving frame member 10, the rotating frame member 18 and the stapler 4 move linearly toward the left side in FIG. 9 along the guiding bar 9. The respective linear moving distances of the first moving frame member 10, the rotating frame member 18 and the stapler 4 at this time are proportional to the rotation angle θ of the gear 20 as shown in FIG. 12. Further, when the gear 20 is rotated within the first angle range θ1, the abutment portion 23 of the gear 20 is not in abutment with the stopper projection 18*a* of the rotating frame member 18. Accordingly, the stapler 4 is not rotated, and its rotation angle indicates 0 as shown in FIG. 12.

The first moving frame member 10 and the second moving frame member 11 are connected by the rack-and-pinion structure 15 as described above. Accordingly, when the first moving frame member 10 moves toward the left side in FIG. 9 linearly, the second moving frame member 11 and the stapler 5 mounted thereon moves in the opposite direction (right side in FIG. 9) linearly along the guiding bar 9 by the same distance.

As described above, when the gear 20 rotates within the first angle range θ1, the stapler 4 and the stapler 5 move in the opposite direction from one another linearly by the same distance, and then stop at an appropriate position in accordance with the size of the stacked sheets to perform stapling such as front-stapling, rear-stapling, and two-point stapling.

In the case of performing the corner stapling with respect to the stacked sheets, the controller 105 allows the gear 20 to be further rotated. At a time when the rotation angle θ of the gear 20 reaches θ1, the engagement shaft 17 engages in a start point 22*d* of the arcuate groove 22*b* of the engagement groove 22, as shown in FIG. 10. At this time, the abutment portion 23 of the gear 20 comes in abutment with the stopper projection 18*a* of the rotating frame member 18. Also, at this time, the staplers 4 and 5 are stopped while being spaced apart by the maximum distance.

When the gear 20 is further rotated in the clockwise direction, the rotating frame member 18 and the stapler 4 are rotated in the same direction (clockwise direction) about the rotational shaft 19 together with the gear 20. Specifically, as shown in FIG. 12, when the rotation angle θ of the gear 20 becomes greater than the first angle range θ1, the first and second moving frame members 10 and 11 and the staplers 4 and 5 do not further move linearly, and only the stapler 4 is rotated together with the gear 20 in the same direction (clockwise direction).

As shown in FIG. 11, when the gear 20 is rotated entirely over the second angle range θ2 until the engagement shaft 17 engages with an end point 22*e* of the second arcuate groove 22*b*, the stapler 4 is rotated together with the rotating frame member 18 about the rotational shaft 19 in the same direction (clockwise direction) entirely over the second angle range θ2 (45 degrees in the present embodiment). Accordingly, the corner stapling is performed by the stapler 4 with respect to the stack of sheets.

The stack of sheets which are stapled is conveyed to the sheet-discharging tray 7 by the conveying belt 6 shown in FIG. 1 and discharged to the sheet-discharging tray 7 to be stacked thereon.

As described above, according to the sheet post-processing apparatus 1 in accordance with the present invention, the rotation of the gear 20 by the motor 16 as a single drive power source allows the pair of stapler 4 and 5 to move linearly in the opposite directions from each other and also allows only one stapler 4 to be rotated. Accordingly, stapling processing including the corner stapling can be performed by the single motor 16. As a result, reduction in the number of components, reduction in the cost in accordance with the reduction in the number of components, and simplification of the control of the drive power source 16 can be achieved.

In the present embodiment, the rotating member is constituted by the gear 20. However, the rotating member may be constituted by a member other than the gear 20, for example, a pulley.

The embodiment described above mainly includes the invention having the following configuration.

A sheet post-processing apparatus in accordance with the present embodiment includes a stack tray on which a plurality of sheets is stacked, a first stapler and a second stapler for stapling the stack of sheets on the stack tray, a first moving frame member on which the first stapler is mounted rotatably, a second moving frame member on which the second stapler is mounted, an interlocking mechanism for interlocking the first moving frame member and the second moving frame member to allow the first moving frame member and the second moving frame member to move linearly in opposite directions from each other, a fixed frame member for supporting the first moving frame member and the second moving frame member in such a manner that the first moving frame member and the second moving frame member can undergo the linear movement, a rotating member rotatably mounted on the first moving frame member, the rotating member so held in engagement with the first moving frame member as to move linearly the first moving frame member by rotation of the rotating member, and also rotating the first stapler by rotation of the rotating member, and a single drive power source for driving the rotating member.

In the configuration above, it is preferable that the rotating member is so configured as to be rotatable about its rotation center over a first angle range and a second angle range continuing from the first angle range with respect to the rotation center and that the first moving frame member is linearly moved by the rotation of the rotating member when the rotating member is rotated by the drive power source over the first angle range, and the first stapler is rotated by the rotation of the rotating member when the rotating member is rotated beyond the first angle range and over the second angle range.

In the configuration above, it is preferable that the rotating member has an engagement groove engaging with an engagement shaft supported by the fixed frame member and also that the engagement groove has a first arcuate groove extending over an angle range corresponding to the first angle range and a second arcuate groove extending over an angle range corresponding to the second angle range.

In the configuration above, it is preferable that the first arcuate groove is formed to be a spiral-like groove that extends from the vicinity of the rotation center of the rotating member with a distance between the rotation center of the rotating member and the first arcuate groove increasing gradually over the first angle range and also that the second arcuate groove is so formed that a distance between the rotation center of the rotating member and the second arcuate groove is constant over the second angle range.

In the configuration above, it is preferable that the distance between the rotation center of the rotating member and the first arcuate groove becomes larger over the first angle range as the rotation angle of the rotating member becomes larger.

In the configuration above, it is preferable that the rotating member is in the form of a gear having an end face formed with the engagement groove.

In the configuration above, it is preferable that the gear has a first abutment portion, and the first stapler has a second abutment portion and also that when the gear rotates within the second angle range, the first abutment portion comes in abutment with the second abutment portion to rotate the first stapler.

In the configuration above, it is preferable that the interlocking mechanism is in the form of a rack-and-pinion mechanism having racks mounted respectively on the first moving frame member and the second moving frame member and a pinion in mesh with the lacks.

In the configuration above, it is preferable that the sheet post-processing apparatus further includes a rotating frame member on which the first stapler is mounted and which is mounted rotatably on the first moving frame member and that the first stapler is rotated by the rotation of the rotating member through the rotating frame member.

This application is based on Japanese Patent application serial No. 2007-128773 filed in Japan Patent Office on May 15, 2007 the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet post-processing apparatus comprising:

a stack tray on which a plurality of sheets is stacked;

a first stapler and a second stapler for stapling the stack of sheets on the stack tray;

a first moving frame member on which the first stapler is mounted rotatably;

a second moving frame member on which the second stapler is mounted;

an interlocking mechanism for interlocking the first moving frame member and the second moving frame member to allow the first moving frame member and the second moving frame member to move linearly in opposite directions from each other;

a fixed frame member for supporting the first moving frame member and the second moving frame member in such a manner that the first moving frame member and the second moving frame member can undergo the linear movement;

a rotating member rotatably mounted on the first moving frame member, the rotating member so held in engagement with the first moving frame member as to move linearly the first moving frame member by rotation of the rotating member, and also rotating the first stapler by rotation of the rotating member; and a single drive source for driving the rotating member, wherein the rotating member is so configured as to be rotatable about a rotation center thereof over a first angle range and a second angle range continuing from the first angle range with respect to the rotation center;

the first moving frame member is linearly moved by the rotation of the rotating member when the rotating member is rotated by the drive source over the first angle range, and the first stapler is rotated by the rotation of the rotating member when the rotating member is rotated beyond the first angle range and over the second angle range;

the rotating member has an engagement groove engaging with an engagement shaft supported by the fixed frame member; and the engagement groove has a first arcuate groove extending over an angle range corresponding to the first angle range and a second arcuate groove extending over an angle range corresponding to the second angle range.

2. The sheet post-processing apparatus according to claim 1, wherein the first arcuate groove is formed to be a spiral-like groove that extends from the vicinity of the rotation center of the rotating member with a distance between the rotation center of the rotating member and the first arcuate groove increasing gradually over the first angle range; and wherein the second arcuate groove is so formed that a distance between the rotation center of the rotating member and the second arcuate groove is constant over the second angle range.

3. The sheet post-processing apparatus according to claim 2, wherein the distance between the rotation center of the rotating member and the first arcuate groove becomes larger over the first angle range as the rotation angle of the rotating member becomes larger.

4. The sheet post-processing apparatus according to claim 1, wherein the rotating member is in the form of a gear having one side formed with the engagement groove.

5. The sheet post-processing apparatus according to claim 4, wherein the gear has a first abutment portion, and the first stapler has a second abutment portion; and wherein when the gear rotates within the second angle range, the first abutment portion comes in abutment with the second abutment portion to rotate the first stapler.

6. The sheet post-processing apparatus according to claim 1, wherein the interlocking mechanism is in the form of a rack-and-pinion mechanism having racks mounted respectively on the first moving frame member and the second moving frame member and a pinion in mesh with the racks.

7. The sheet post-processing apparatus according to claim 1, further comprising:

a rotating frame member on which the first stapler is mounted, the rotating frame member being mounted rotatably on the first moving frame member; and wherein the first stapler is rotated by the rotation of the rotating member through the rotating frame member.

8. An image forming apparatus provided with a sheet post-processing apparatus, the image forming apparatus comprising:

an apparatus main body for forming a toner image on a plurality of sheets; and a sheet post-processing apparatus connected to the apparatus main body for stacking the plurality of sheets and stapling the stack of sheets;

the sheet post-processing apparatus including:

a stack tray on which a plurality of sheets is stacked;

a first stapler and a second stapler for stapling the stack of sheets on the stack tray;

a first moving frame member on which the first stapler is mounted rotatably;

a second moving frame member on which the second stapler is mounted;

an interlocking mechanism for interlocking the first moving frame member and the second moving frame member to allow the first moving frame member and the second moving frame member to move linearly in opposite directions from each other;

a fixed frame member for supporting the first moving frame member and the second moving frame member in such a manner that the first moving frame member and the second moving frame member can undergo the linear movement;

a rotating member rotatably mounted on the first moving frame member, the rotating member so held in engagement with the first moving frame member as to move linearly the first moving frame member by rotation of the rotating member, and also rotating the first stapler by rotation of the rotating member; and a single power source for driving the rotating member, wherein the rotating member is so configured as to be rotatable about its rotation center over a first angle range and a second angle range continuing from the first angle range with respect to the rotation center;

the first moving frame member is linearly moved by the rotation of the rotating member when the rotating member is rotated by the drive source over the first angle range, and the first stapler is rotated by the rotation of the rotating member when the rotating member is rotated beyond the first angle range and over the second angle range;

the rotating member has an engagement groove engaging with an engagement shaft supported by the fixed frame member; and wherein the engagement groove has a first arcuate groove extending over an angle range corresponding to the first angle range and a second arcuate groove extending over an angle range corresponding to the second angle range.

9. The image forming apparatus according to claim 8, wherein the first arcuate groove is formed to be a spiral-like groove that extends from the vicinity of the rotation center of the rotating member with a distance between the rotation center of the rotating member and the first arcuate groove increasing gradually over the first angle range; and wherein the second arcuate groove is so formed that a distance between the rotation center of the rotating member and the second arcuate groove is constant over the second angle range.

10. The image forming apparatus according to claim 9, wherein the distance between the rotation center of the rotating member and the first arcuate groove becomes larger over the first angle range as the rotation angle of the rotating member becomes larger.

11. The image forming apparatus according to claim 8, wherein the rotating member is in the form of a gear having one side formed with the engagement groove.

12. The image forming apparatus according to claim 11, wherein the gear has a first abutment portion, and the first stapler has a second abutment portion; and wherein when the gear rotates within the second angle range, the first abutment portion comes in abutment with the second abutment portion to rotate the first stapler.

13. The image forming apparatus according to claim 8, wherein the interlocking mechanism is in the form of a lack rack-and-pinion mechanism having racks mounted respectively on the first moving frame member and the second moving frame member and a pinion in mesh with the lacks.

14. The image forming apparatus according to claim 8, further comprising:

a rotating frame member on which the first stapler is mounted, the rotating frame member being mounted rotatably on the first moving frame member; and wherein the first stapler is rotated by the rotation of the rotating member through the rotating frame member.

* * * * *